US008632174B2

(12) United States Patent
Noguchi et al.

(10) Patent No.: US 8,632,174 B2
(45) Date of Patent: Jan. 21, 2014

(54) INK JET RECORDING METHOD

(75) Inventors: Soh Noguchi, Kanagawa (JP); Okitoshi Kimura, Kanagawa (JP); Tsutomu Maekawa, Kanagawa (JP); Takao Hiraoka, Kanagawa (JP); Tomoko Hasegawa, Ibaraki (JP); Eiji Noda, Kanagawa (JP); Shinya Seno, Kanagawa (JP); Noriyasu Takeuchi, Kanagawa (JP); Tamotsu Aruga, Saitama (JP); Masayuki Koyano, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 94 days.

(21) Appl. No.: 13/243,676

(22) Filed: Sep. 23, 2011

(65) Prior Publication Data

US 2012/0086762 A1 Apr. 12, 2012

(30) Foreign Application Priority Data

Oct. 8, 2010 (JP) ..... 2010-228393

(51) Int. Cl.
*B41J 2/01* (2006.01)

(52) U.S. Cl.
USPC ..... 347/100; 347/95

(58) Field of Classification Search
USPC ..... 347/100, 95, 101, 102, 96, 88, 99, 21, 347/20, 9; 106/31.6, 31.13, 31.27; 523/160, 523/161
See application file for complete search history.

(56) References Cited

U.S. PATENT DOCUMENTS

| | | | | |
|---|---|---|---|---|
| 6,106,602 | A | 8/2000 | Ouchi et al. | |
| 2005/0250869 | A1 * | 11/2005 | Claes et al. | 522/71 |
| 2006/0092254 | A1 * | 5/2006 | Claes et al. | 347/102 |
| 2008/0180503 | A1 * | 7/2008 | Umebayashi | 347/102 |
| 2010/0196602 | A1 | 8/2010 | Koyano et al. | |
| 2011/0057981 | A1 | 3/2011 | Aruga et al. | |
| 2011/0060100 | A1 | 3/2011 | Kimura et al. | |

FOREIGN PATENT DOCUMENTS

| | | |
|---|---|---|
| JP | 2005-60520 | 3/2005 |
| JP | 2008-23980 | 2/2008 |
| JP | 2008-248070 | 10/2008 |
| JP | 2010-76138 | 4/2010 |

OTHER PUBLICATIONS

Claims, Abstract and Drawings in U.S. Appl. No. 13/117,548.

* cited by examiner

*Primary Examiner* — Manish S Shah
(74) *Attorney, Agent, or Firm* — Cooper & Dunham LLP

(57) ABSTRACT

A method of ink jet recording including forming an uncured first ink layer of a first ultraviolet curable ink A on a recording medium, forming an uncured second ink layer having a recording pattern inside the uncured first ink layer of the ink A by discharging a second ultraviolet curable ink B from an ink jet head, and curing the uncured first ink layer by irradiating the uncured first ink layer with ultraviolet light after forming the uncured second ink layer, wherein the ink A contains a photoradical generator and the ink B contains a photobase generator and a coloring agent.

7 Claims, No Drawings

INK JET RECORDING METHOD

CROSS-REFERENCE TO RELATED APPLICATIONS

This patent application is based on and claims priority pursuant to 35 U.S.C. §119 to Japanese Patent Application No. 2010-228393, filed on Oct. 8, 2010, in the Japan Patent Office, the entire disclosure of which is hereby incorporated by reference herein.

BACKGROUND OF THE INVENTION

1. Field of the Invention

The present invention relates to an ink jet recording method employing an ink jet system for photocopiers, printers, facsimile machines, etc.

2. Description of the Background Art

Among many printing systems, the ink jet recording system finds application over a wide range of printing fields since it can form images simply and inexpensively. In the ink jet recording technology, ink droplets that are formed through minute nozzles are attached to a recording medium such as paper according to image information using a pressure on-demand system, a charge control system, etc. Such an ink jet recording technology is suitably applied to image forming apparatuses such as printers, facsimile machines, and photocopiers. Since images can be formed by directly attaching ink to a recording medium in the ink jet recording technology, recording can be performed by a relatively simple device structure in comparison with indirect recording technologies such as electrophotography using an image bearing member.

However, printing performance and in particular printing speed has improved in the printing industry in recent years. Consequently, the typical aqueous ink or oil-based ink ejected onto the recording medium does not dry in time. To solve such a problem, using ultraviolet curable ink which is dried (cured) instantly upon irradiation by light on any kind of recording medium is proposed.

A specific example of ultraviolet curable ink is a combination of a radical reactive compound (radical monomer) and a photoradical initiator. This system is characterized by an extremely quick reaction but has a problem in that radicals generated by irradiation by light are soon deactivated by oxygen in the air, thereby terminating the reaction prematurely. In such a case, radical monomers having a low molecular weight remain in the ink, which causes problems with regard to safety, etc.

On the other hand, a system using a combination of a cation reactive compound (cation monomer) and a photo-acid-generating agent is known to prevent inhibition by oxygen. In this combination, since a reactive strong acid is not inhibited by oxygen (although susceptible to moisture and a base), the reaction (post-curing) continues after irradiation by light so that the remaining monomer can be reduced. However, the presence of such a strong acid causes problems such as corrosion or degeneration of printed media.

Further, although there are only a few examples, a system using a combination of an anion reactive compound (anion monomer) and a photobase generator is also known. For example, unexamined Japanese patent application publication no, 2005-060520 (JP-2005-060520-A) describes a curable composition used as ink for ink jet printing that is cured by adding an overt and/or potential base to an alicyclic epoxy monomer having a specific structure.

In such a system, similar to the cation system, a reactive base is not deactivated soon, so the reaction continues after irradiation by light. In addition, a weak base can be used, thereby causing no problem of corrosion or degeneration of printed media. However, with this system increasing the printing speed is difficult because the reaction speed is slow.

Moreover, if ink of the system described above is used as an ultraviolet curable ink, in particular an ink having a coloring agent, the curability thereof deteriorates and curing does not proceed sufficiently by initial irradiation by light.

Furthermore, in general, if an ultraviolet curable ink for ink jet printing is used for a non-permeable media in particular, the ink discharged is cured before permeation and leveling, so that ink dots tends to swell, resulting in formation of a rough surface. This leads to a problem of non-uniform gloss between the background portion and printed portion, which gives a sense of discomfort. Consequently, a good-quality image is difficult to obtain.

On the other hand, there is a known technology in which an ultraviolet curable clear liquid is applied to a recording medium as an undercoating where a colored ink is discharged, thereby preventing ooze and mixing between droplets. For example, JP-2008-248070-A describes usage of a colored liquid containing a cation polymerizable compound and a liquid for an underlying layer containing a radical polymerizable compound. JP-2010-076138-A describes usage of a colored liquid and a liquid for an underlying layer both of which contain a cation polymerizable compound. In addition, JP-2008-023980-A describes printing images after half-curing an undercoating.

In this method, quality images are formed on recording media by preventing surface deterioration of a liquid-applied surface that may occur in the process of applying a liquid for the underlying layer to the recording media. That is, the underlying layer is half-cured before the ink is discharged to prevent excessive spreading of ink droplets. However, satisfying the curing conditions that create this half-cured state is difficult, with the result that the underlying layer is not stably half-cured but completely or barely cured. As a consequence, the ink droplets do not uniformly spread.

SUMMARY OF THE INVENTION

In view of the foregoing, the present invention provides novel method of ink jet recording including forming an uncured layer of a first ultraviolet curable ink A on a recording medium, forming an ink layer containing a recording pattern inside the uncured layer of the ink A by discharging a second ultraviolet curable ink B from an ink jet head, and curing the uncured layer or the ink layer by irradiating the ink layer with ultraviolet light after forming the ink layer, wherein the ink A contains a photoradical generator and the ink B contains a photobase generator and a coloring agent.

It is preferred that, in the method of ink jet recording mentioned above, the ink A and the ink B independently further contains compounds reactive with both a radical and a base.

It is still further preferred that, in the method of ink jet recording mentioned above, the compounds reactive with both a radical and a base are independently acrylates or methacrylates.

It is still further preferred that, in the method of ink jet recording mentioned above,

DETAILED DESCRIPTION OF THE INVENTION

The method of ink jet recording of ultraviolet curing type of the present disclosure includes a process of forming an uncured layer of a first ultraviolet curable ink A on a recording medium, a process of forming a recording pattern inside the uncured layer of the ink A by discharging a second ultraviolet curable ink B from an ink jet head, and a process of curing the ink layer by irradiating the ink layer with ultraviolet light after forming the recording pattern. The ink A contains a photoradical generator and the ink B contains a photobase generator and a coloring agent.

In the present disclosure, an uncured layer of the first ultraviolet curable ink A is formed on a recording medium and thereafter the second ultraviolet curable ink B is driven inside the uncured layer of the ink A to reduce the roughness of the layer. The ink A is preferably imparted in the same area of the image formed on the recording medium by the ink B or an area wider than that.

It is preferable that the ink A is a clear liquid without a coloring agent in terms of image forming but it is also suitable to use a pale color ink A having a small amount of a coloring agent. The ink B contains a coloring agent for image forming. In addition, the ink B, which is difficult to cure because of the coloring agent contained therein, may have a photobase generator to impart post-curability. Such an ink B can be cured even if the amount of light for irradiation is not sufficient.

In the present disclosure, the ink B is not necessarily cured if the ink A that contains no or a small amount of a coloring agent is quickly cured because the ink B is inside the ink A. Therefore, there is an advantage that the next process can start without waiting for the ink B to be cured because the exterior is cured even if the irradiation by light is stopped in an amount just enough to cure the ink A.

Moreover, by using an anion reaction instead of a cation reaction, the corrosion or degeneration of printing media can be avoided and furthermore, there is a merit that common materials can be selected for the ink A and the ink B by using a compound (monomer) that easily reacts with a radical or an anion such as a (meth)acrylate. If the materials for the inks are used in common, there are merits which lead to reduction of the cost and cause no problems about compatibility (not mixed but rejected), etc. That is, it is preferable that the ink A and the ink B contain a common photoradical generator, a photobase generator, and a compound that reacts with both of a radical and a base.

These inks optionally contain various additives to improve the discharging stability, the preservation stability, and other characteristics. In addition, in order to adjust the viscosity of the ink, various solvents can be contained therein.

Known polymerizable functional groups can be used as the functional groups that react with a base and a radical. Among these, (meth)acrylic compounds, (meth)acrylamides, vinyl compounds, mercaptanes, and silyl compounds are preferable in terms of the curing speed. In addition, these compounds may be monofunctional or can be combined to be multi-functional.

Specific examples thereof include, but are not limited to, the following:

(A-1)

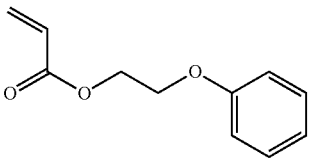

-continued

A-2

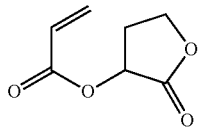

(A-3)

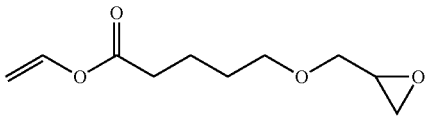

(A-4)

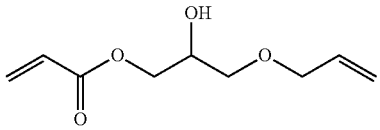

(A-5)

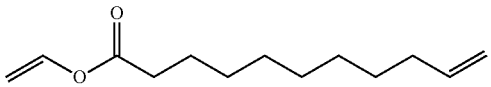

(A-6)

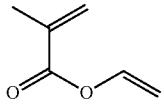

(A-7)

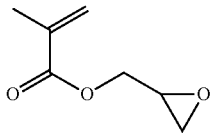

A-8

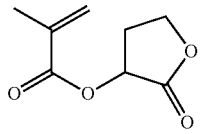

(A-9)

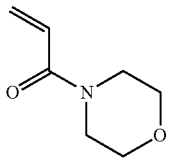

(A-10)

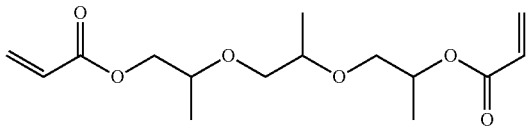

(A-11)

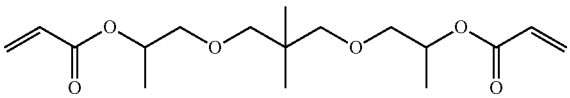

(A-12)

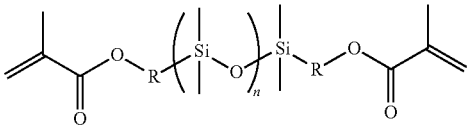

-continued (A-13)

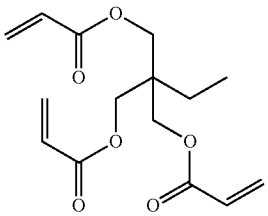

(A-14)

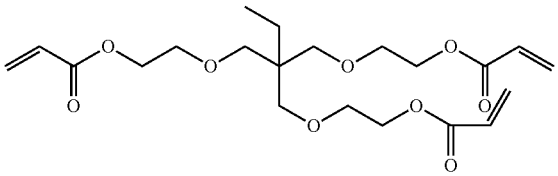

(A-15)

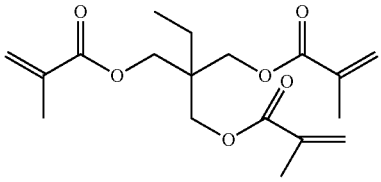

(A-16)

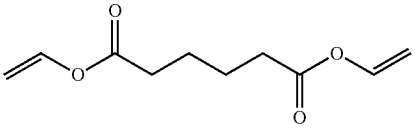

(A-17)

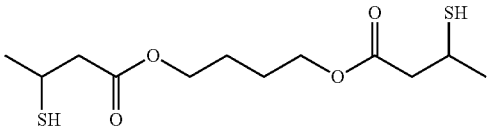

(A-18)

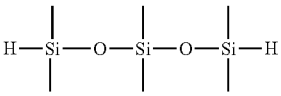

Furthermore, known photoreaction initiators can be suitably used.

The ink A of which a quick curing is required contains a photoradical generator. Any known photoradical polymerization initiator can be used as the photoradical generator. Preferred specific examples thereof include, but are not limited to, benzophenones, alkylphenones, acylphosphine oxides, oxyphenyl acetic acid esters, benzoinethers, oxime esters, and thioxanthones.

Specific examples thereof include, but are not limited to, the following:

(B-1)

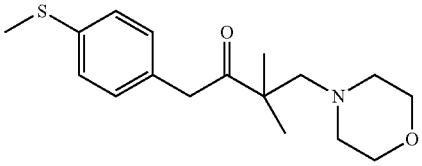

-continued (B-2)

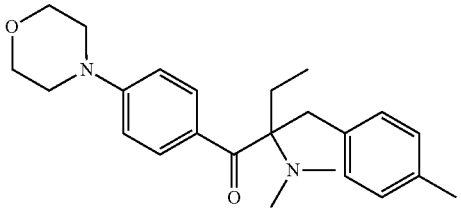

(B-3)

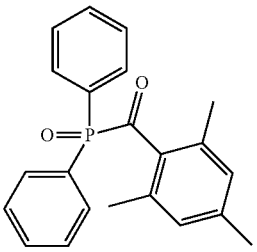

(B-4)

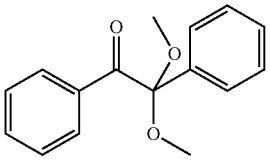

The ink B contains a photobase generator to utilize a post-curing reaction. The photobase generator can be contained in both the ink A and the ink B. Any known photobase generator can be used and it is preferable to use oxime esters, quaternary ammoium salts, acyl compounds, carbamate compounds, and amino acetophenones.

Specific examples thereof include, but are not limited to, the following:

(C-1)

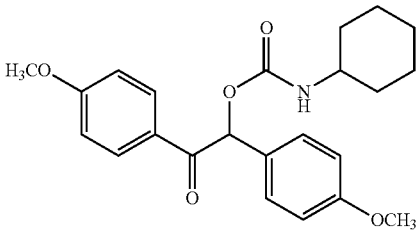

(C-2)

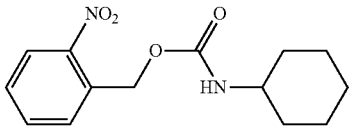

(C-3)

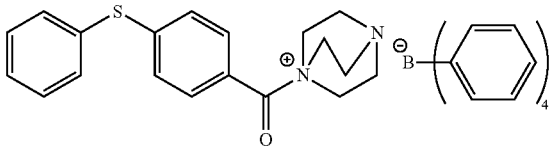

-continued (C-4)

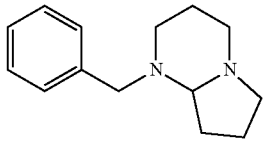

The added amount of the photoradical generator in the ink A is from about 3 to 25 parts by weight based on 100 parts by weight of a polymerizable compound. The added amount of the photobase generator in the ink B is from about 3 to 25 parts by weight based on 100 parts by weight of a polymerizable compound.

Any known dye and pigment can be used as a color material (coloring agent). When a pigment is used, a dispersing agent, etc. can be optionally used. It is particularly preferable to use a color material having an excellent light resistance and an excellent color reproducibility which does not affect curing reaction or serve as a polymerization inhibitor.

Any known ink receptors (recording media) can be used for the ink of the present disclosure. Specific examples thereof include, but are not limited to, plain paper, coated paper, non-permeable plastic film, metals, and glass.

In the present invention, known devices such as a mercury lamp, a metal hydride lamp, a xenon lamp, and an LED can be used as the light source that irradiates a recording medium with ultraviolet light after a pattern is formed.

Having generally described (preferred embodiments of) this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Examples 1 to 9 and Comparative Examples 1 to 3

Ink composition of Examples and Comparative Examples are prepared by the materials and the composition ratio shown in Table 1. The pigments used are as follows:

CB: MICROLITH Black C-K (carbon black pigment), manufactured by BASF Japan)

Blue: MICROLITH Blue 4G-K, manufactured by BASF Japan.

In addition, the (base) reactive compound used in Comparative Example 3 is as follows:

(D-1)

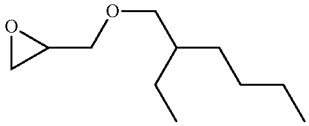

Evaluation

Each ink of Examples and Comparative Examples is irradiated with light (ultraviolet light) using a high pressure mercury lamp to evaluate the curability of the colored ink after it is cured. The colored ink is checked with regard to the surface tack by finger touch immediately after irradiation of light. The internal curing is confirmed by pressing the colored ink strongly with a finger one day after the irradiation of light.

The evaluation results are shown in Table 1.

TABLE 1

| | Ink A | | | | | |
|---|---|---|---|---|---|---|
| | Compound | | Polymerization Initiator | | Pigment | |
| | mono-mer | Parts by weight | Polymeri-zation initiator | Parts by weight | Pigment | Parts by weight |
| Example 1 | A-10 | 100 | B-1 | 10 | — | — |
| Example 2 | A-10 | 100 | B-1 | 10 | — | — |
| Example 3 | A-9 | 100 | B-2 | 15 | — | — |
| Example 4 | A-8 | 50 | B-1 | 20 | — | — |
| | A-15 | 50 | | | | |
| Example 5 | A-1 | 40 | B-2 | 5 | — | — |
| | A-14 | 60 | | | | |
| Example 6 | A-1 | 40 | B-2 | 5 | — | — |
| | A-14 | 60 | C-1 | 10 | | |
| Example 7 | A-2 | 70 | B-1 | 10 | — | — |
| | A-13 | 30 | B-3 | 10 | | |
| Example 8 | A-6 | 60 | B-2 | 10 | — | — |
| | A-12 | 40 | | | | |
| Example 9 | A-10 | 100 | B-1 | 10 | Blue | 0.5 |
| Comparative Example 1 | A-1 | 40 | B-2 | 5 | — | — |
| | A-14 | 60 | | | | |
| Comparative Example 2 | A-10 | 100 | C-1 | 10 | — | — |
| Comparative Example 3 | D-1 | 100 | B-1 | 10 | — | — |

| | Ink B | | | | | |
|---|---|---|---|---|---|---|
| | Compound | | Polymerization Initiator | | Pigment | |
| | Mono-mer | Parts by weight | Polymeri-zation initiator | Parts by weight | Pigment | Parts by weight |
| Example 1 | A-10 | 100 | C-1 | 10 | CB | 3 |
| Example 2 | A-8 | 50 | C-1 | 10 | CB | 3 |
| | A-15 | 50 | | | | |
| Example 3 | A-9 | 100 | B-2 | 10 | CB | 7 |
| | | | C-1 | 10 | | |
| Example 4 | A-8 | 50 | C-4 | 10 | Blue | 3 |
| | A-15 | 50 | | | | |
| Example 5 | A-1 | 40 | C-1 | 15 | CB | 5 |
| | A-14 | 60 | | | | |
| Example 6 | A-1 | 40 | B-2 | 5 | | 3 |
| | A-14 | 60 | C-1 | 10 | CB | |
| Example 7 | A-2 | 70 | C-4 | 10 | CB | 3 |
| | A-13 | 30 | | | | |
| Example 8 | A-6 | 60 | C-1 | 10 | Blue | 3 |
| | A-12 | 40 | | | | |
| Example 9 | A-10 | 100 | C-1 | 10 | CB | 3 |
| Comparative Example 1 | A-1 | 40 | B-2 | 5 | CB | 5 |
| | A-14 | 60 | | | | |
| Comparative Example 2 | A-10 | 100 | C-1 | 10 | CB | 3 |
| Comparative Example 3 | D-1 | 100 | C-4 | 10 | CB | 3 |

| | Evaluation | | |
|---|---|---|---|
| | Irradiation amount ($J/cm^2$) | Surface tack | Inside curing |
| Example 1 | 2 | None | Good |
| Example 2 | 2 | None | Good |
| Example 3 | 7 | None | Good |
| Example 4 | 5 | None | Good |
| Example 5 | 1.2 | None | Good |
| Example 6 | 1.2 | None | Good |
| Example 7 | 1 | None | Good |
| Example 8 | 3 | None | Good |
| Example 9 | 4 | None | Good |
| Comparative | 1.2 | None | Bad |

TABLE 1-continued

| | | | |
|---|---|---|---|
| Example 1 | | | |
| Comparative Example 2 | 20 | Yes | — |
| Comparative Example 3 | 20 | Yes | — |

Inside curing is not evaluated for ink having a surface tack

As seen in the results for Comparative Example 1, it is found that the surface tack can be eliminated but the colored ink is not sufficiently cured to the inside thereof if the ink B does not contain a base generator.

As seen in the results for Comparative Example 2, it is found that the surface is not sufficiently cured even with a ten-fold amount of irradiation by light unless the ink A contains a photoradical generator.

As seen in the results for Comparative Example 3, it is found that the surface is not sufficiently cured even with a ten-fold amount of irradiation by light if a photoreactive material that is not radically reactive is used.

The method of ink jet recording of ultraviolet curing type of the present disclosure can be suitably used as a recording method for a photocopier, a printer, a facsimile machine, etc. because the image uniformity between recording media is high whether a non-permeable or permeable recording medium is used and ink ooze, non-uniform line width ascribable to mixing of droplets, non-uniform coloring can be reduced.

Having now fully described the invention, it will be apparent to one of ordinary skill in the art that many changes and modifications can be made thereto without departing from the spirit and scope of the invention as set forth therein.

What is claimed is:

1. An inkjet recording method comprising:

forming an uncured first ink layer of a first ultraviolet curable ink A on a recording medium;

forming an uncured second ink layer comprising a recording pattern inside the uncured first ink layer of the ink A by discharging a second ultraviolet curable ink B from an ink jet head; and curing the uncured first ink layer by irradiating the uncured first ink layer with ultraviolet light after forming the uncured second ink layer, wherein the ink A comprises a photoradical generator and the ink B comprises a photobase generator and a coloring agent, and wherein the photobase generator is selected from the group consisting of oxime esters, quaternary ammonium salts, and carbamate compounds.

2. The inkjet recording method according to claim 1, wherein the step of irradiating the uncured first ink layer includes curing the uncured second ink layer.

3. The inkjet recording method according to claim 1, wherein the ink A and the ink B further comprise compounds reactive with both a radical and a base.

4. The inkjet recording method according to claim 3, wherein the compounds reactive with both a radical and a base are acrylates or methacrylates.

5. The inkjet recording method according to claim 3, wherein the ink A further comprises the photobase generator of the ink B and the ink B further comprises the photoradical generator of the ink A.

6. The inkjet according method according to claim 1, wherein the ink A further comprises a coloring agent.

7. The inkjet recording method according to claim 1, wherein an amount of photoradical generator in the ink A is from about 3 to 25 parts by weight based on 100 parts by weight of a polymerizable compound, and an amount of the photobase generator in the ink B is from about 3 to 25 parts by weight based on 100 parts by weight of a polymerizable compound.

* * * * *